US009657742B2

(12) United States Patent
Chu

(10) Patent No.: US 9,657,742 B2
(45) Date of Patent: May 23, 2017

(54) SOLAR FAN

(71) Applicant: Ko-Chien Chu, Taoyuan Hsien (TW)

(72) Inventor: Ko-Chien Chu, Taoyuan Hsien (TW)

(73) Assignee: SPEEDTECH ENERGY CO., LTD., Taoyuan Hsien (TW)

( * ) Notice: Subject to any disclaimer, the term of this patent is extended or adjusted under 35 U.S.C. 154(b) by 432 days.

(21) Appl. No.: 14/486,340

(22) Filed: Sep. 15, 2014

(65) Prior Publication Data

US 2016/0076547 A1 Mar. 17, 2016

(51) Int. Cl.

| | |
|---|---|
| ***F04D 25/06*** | (2006.01) |
| ***F04D 29/40*** | (2006.01) |
| ***F04D 25/16*** | (2006.01) |
| ***F04D 29/64*** | (2006.01) |
| ***F04D 29/60*** | (2006.01) |
| ***F04D 29/52*** | (2006.01) |
| ***F04D 25/08*** | (2006.01) |

(52) U.S. Cl.

CPC ..... *F04D 25/0673* (2013.01); *F04D 25/06* (2013.01); *F04D 25/0606* (2013.01); *F04D 25/08* (2013.01); *F04D 25/16* (2013.01); *F04D 25/166* (2013.01); *F04D 29/403* (2013.01); *F04D 29/52* (2013.01); *F04D 29/522* (2013.01); *F04D 29/601* (2013.01); *F04D 29/64* (2013.01); *F04D 29/644* (2013.01)

(58) Field of Classification Search

CPC ..... F04D 25/08; F04D 25/0673; F04D 25/10; F04D 25/105; F04D 25/166; F04D 25/068; F04D 29/522; F04D 29/64; F04D 29/644; F04D 29/646; F04D 29/403; F04D 29/52; F04D 29/002; F04D 29/703; F04D 29/701; G06F 1/203; G06F 1/20

See application file for complete search history.

(56) References Cited

U.S. PATENT DOCUMENTS

| | | | | |
|---|---|---|---|---|
| 3,083,893 A * | 4/1963 | Dean | F04D 19/024 | 310/112 |
| 5,310,313 A * | 5/1994 | Chen | F04D 25/105 | 416/100 |
| 5,411,371 A * | 5/1995 | Chen | F04D 25/105 | 416/100 |
| 6,244,818 B1 * | 6/2001 | Chang | F01D 25/24 | 415/193 |
| 6,406,257 B1 * | 6/2002 | Houdek | F04D 25/166 | 415/213.1 |
| 6,565,334 B1 * | 5/2003 | Bradbury | F04D 29/384 | 361/695 |
| 6,595,743 B1 * | 7/2003 | Kazatchkov | F04D 3/00 | 415/170.1 |
| 6,612,817 B2 * | 9/2003 | Lin | F04D 19/007 | 415/199.5 |
| 6,626,653 B2 * | 9/2003 | Lin | F04D 25/166 | 361/679.46 |

(Continued)

*Primary Examiner* — Bryan Lettman

(74) *Attorney, Agent, or Firm* — Pro-TECHTOR International Services; Ian Oglesby

(57) ABSTRACT

A solar fan has a solar panel deposited inside a transparent protective plate that is positioned at a surface of a casing, so that solar energy can be converted into electricity that is then transmitted to a solar cell in the casing for storage. The solar fan has two blade sets that can be angularly adjusted with respect to a case of the casing.

6 Claims, 4 Drawing Sheets

(56) References Cited

U.S. PATENT DOCUMENTS 6,632,405 B2 * 10/2003 Lua ..... B01F 3/022 422/123
6,752,587 B2 * 6/2004 Lin ..... F04D 25/166 415/220
6,757,150 B2 * 6/2004 Gorczyca ..... H01T 23/00 361/231
6,799,942 B1 * 10/2004 Tzeng ..... F04D 29/542 415/193
6,904,960 B1 * 6/2005 Su ..... F04D 19/007 165/122
7,054,130 B2 * 5/2006 Gorczyca ..... H01T 23/00 361/230
7,059,830 B2 * 6/2006 Huang ..... F01D 1/02 415/198.1
7,120,019 B2 * 10/2006 Foster, Sr. ..... F04D 19/007 165/80.3
7,156,611 B2 * 1/2007 Oosawa ..... F04D 19/007 415/199.5
7,175,399 B2 * 2/2007 Matsumoto ..... H05K 7/2019 417/423.14
7,445,423 B2 * 11/2008 Ishihara ..... F04D 19/007 415/193
7,561,403 B2 * 7/2009 Onezawa ..... H05F 3/04 361/230
7,866,958 B2 * 1/2011 Patel ..... F04B 17/006 417/234
7,872,381 B2 * 1/2011 Watanabe ..... F04D 19/007 310/58
8,052,379 B2 * 11/2011 Gammack ..... F04D 25/10 415/126
8,079,801 B2 * 12/2011 Yoshida ..... F04D 25/0613 415/199.5
8,113,774 B2 * 2/2012 Yang ..... F04D 25/0613 415/213.1
8,172,501 B2 * 5/2012 Nishizawa ..... F04D 19/007 415/214.1
8,348,593 B2 * 1/2013 Yoshida ..... F04D 19/007 415/66
8,474,728 B2 * 7/2013 Cislo ..... F24F 7/06 236/49.3
8,690,528 B2 * 4/2014 Kato ..... F04D 19/002 415/199.5
8,764,375 B2 * 7/2014 Kato ..... F04D 19/002 415/68
9,513,028 B2 * 12/2016 Gammack ..... F04D 25/08
2002/0197189 A1 * 12/2002 Lua ..... B60H 3/0007 422/124
2003/0116188 A1 * 6/2003 Hsieh ..... F04D 25/06 136/244
2005/0079113 A1 * 4/2005 Selander ..... A61L 9/122 422/306
2005/0226719 A1 * 10/2005 Sun ..... F04D 25/166 415/193
2009/0111372 A1 * 4/2009 Hsu ..... F04D 19/007 454/190
2009/0207547 A1 * 8/2009 Terasaki ..... B03C 3/32 361/231
2010/0119385 A1 * 5/2010 Hanaoka ..... F04D 27/004 417/244
2010/0300511 A1 * 12/2010 Chu ..... H01M 10/465 136/252
2011/0127017 A1 * 6/2011 Cheng ..... F04D 25/045 165/121
2012/0014785 A1 * 1/2012 Chen ..... F04D 25/10 415/182.1
2012/0178357 A1 * 7/2012 Rheaume ..... F04B 17/006 454/343
2013/0272858 A1 * 10/2013 Stickney ..... F04D 25/08 415/182.1

* cited by examiner

SOLAR FAN

BACKGROUND OF THE INVENTION

1. Technical Field

The present invention relates to a solar fan, and more particularly to a solar fan providing enhanced wind power.

2. Description of Related Art

The existing electric fans are most designed having a single head and powered by the grid. For making an electric fan more practical and powered by solar energy, the inventor have done research and development to improve the conventional fans.

SUMMARY OF THE INVENTION

The primary objective of the present invention is to provide a solar fan, which is powered by solar energy and has a dual-layer structure. The solar fan is more power-saving and more effective, thus being an appliance sustainable and friendly to the environment.

For achieving the foregoing objective, the disclosed solar fan comprises a solar panel deposited inside a transparent protective plate that is positioned at a surface of a casing, so that solar energy can be converted into electricity that is then transmitted to a solar cell in the casing for storage. The casing is atop provided with a socket for positioning a projecting head of a rear grille. The projecting head has a positioning slot that allows a rear motor mount to be inserted therein and fixed thereto. The rear motor mount has an upper end combined with a rear motor. A front motor mount is atop fixed with a front motor. The front and rear motors have mandrels thereof installed with a front blade set and a rear blade set, respectively. The front motor mount has a shaft coupled to a frame of the rear motor mount. A front grille is peripherally combined with the rear grille. The casing contains a circuit board that is connected to a switch for speed and power control and an indication lamp set both deposited at a lateral of the casing and to the solar cell. The front and rear motors are electrically connected to the circuit board. Further, a USB socket is deposited at the lateral of the casing and is electrically connected to the circuit board.

The invention as well as a preferred mode of use, further objectives and advantages thereof will be best understood by reference to the following detailed description of illustrative embodiments when read in conjunction with the accompanying drawings.

DETAILED DESCRIPTION OF THE INVENTION

Figure 1:
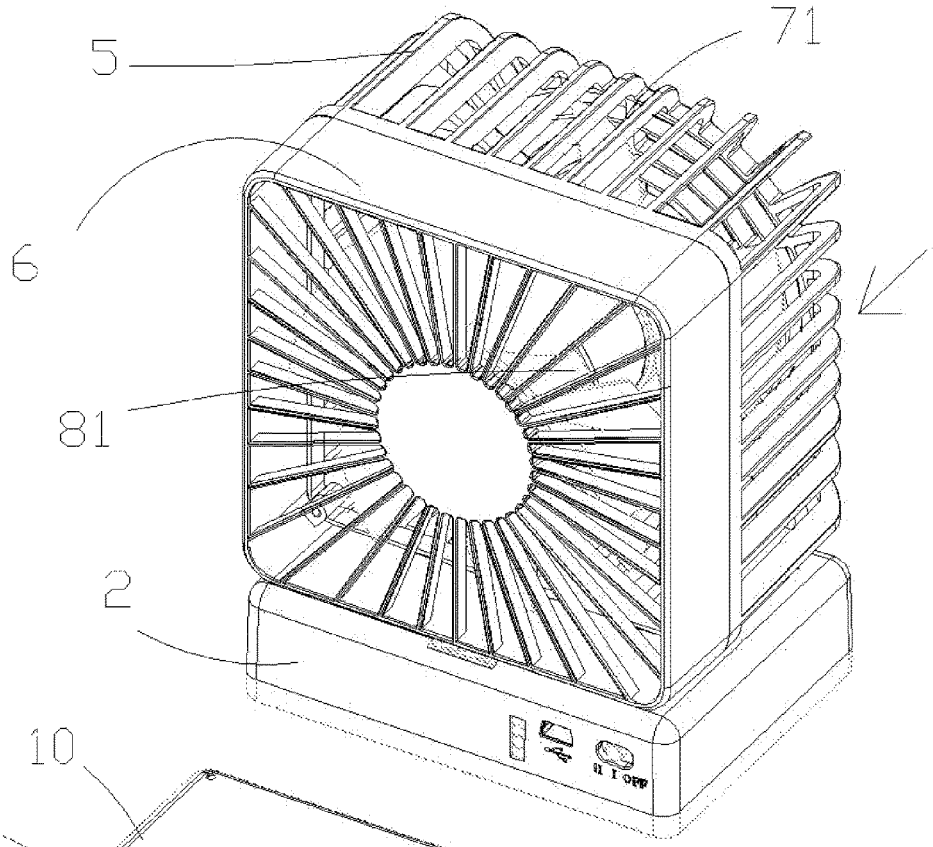
FIG. 1 is a perspective view of a solar fan according to the present invention when used to provide cooling.
Figure 2:
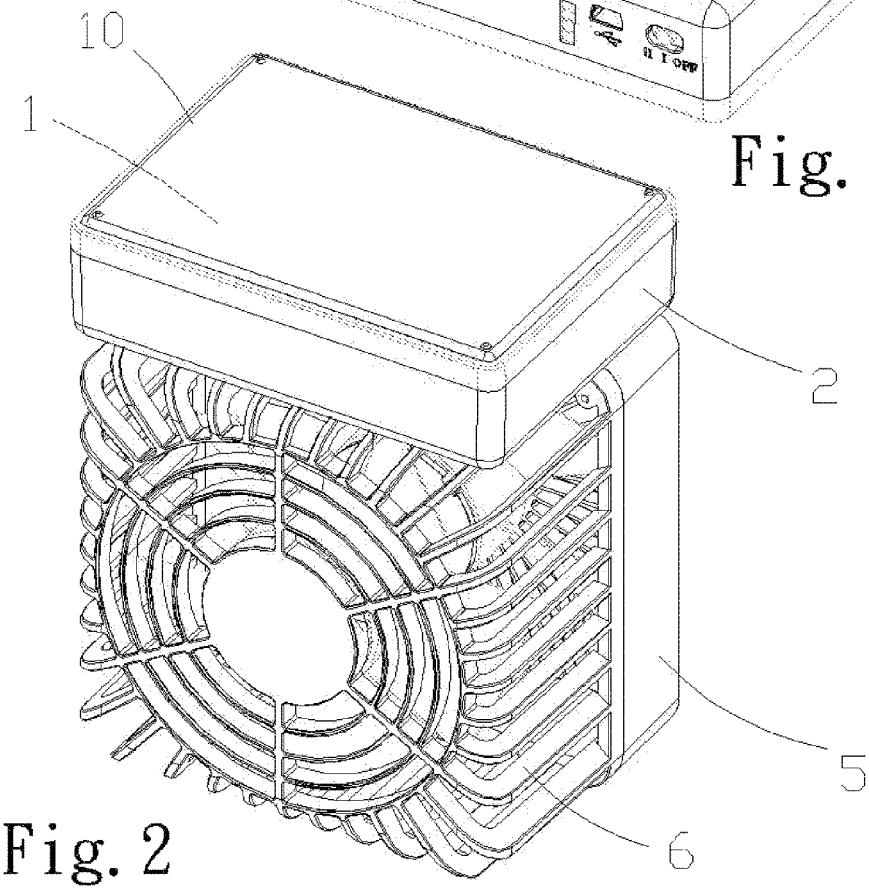
FIG. 2 is another perspective view of the solar fan when being solarized and thus charged.
Figure 3:
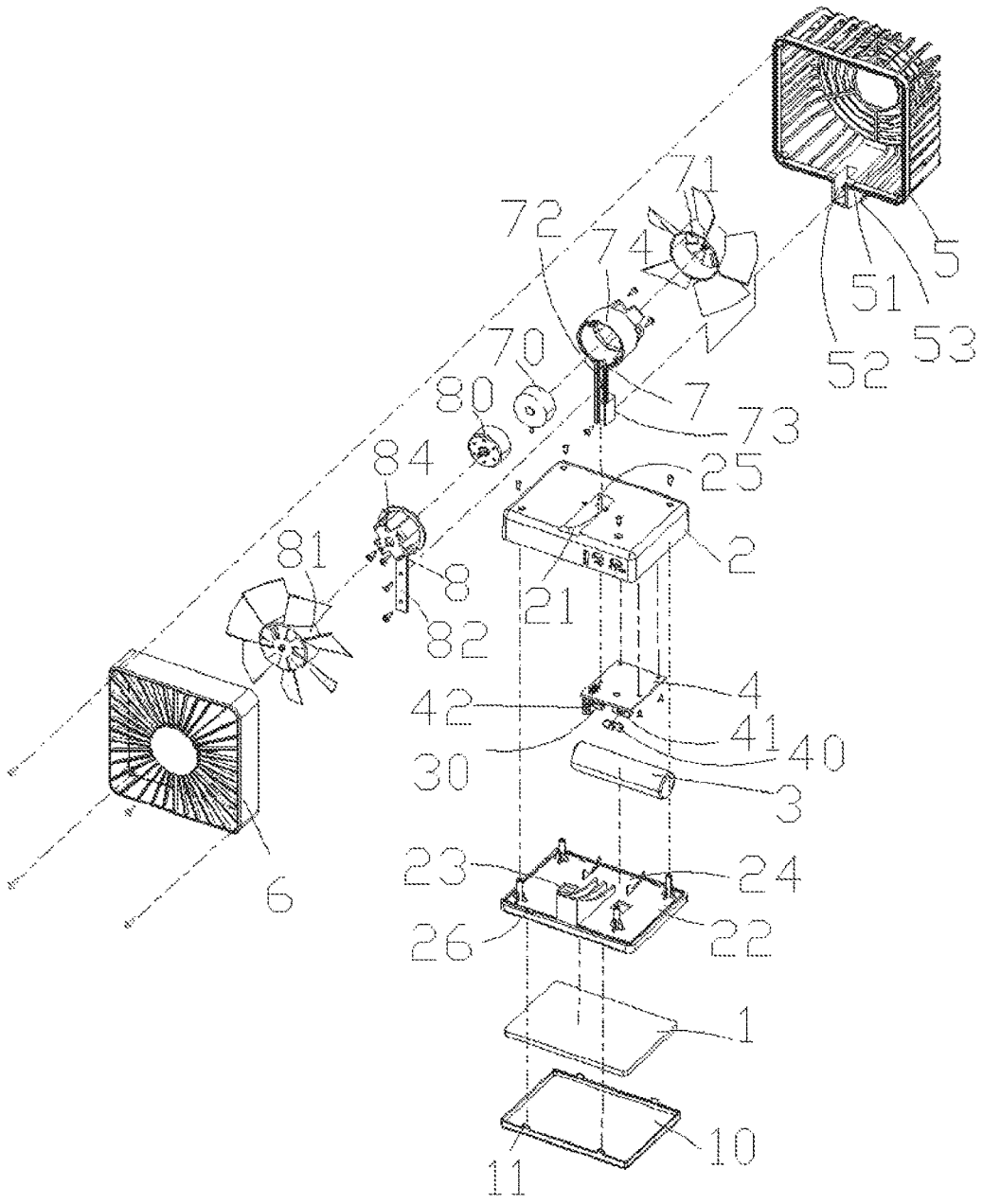
FIG. 3 is an exploded view of the solar fan.
Figure 4:
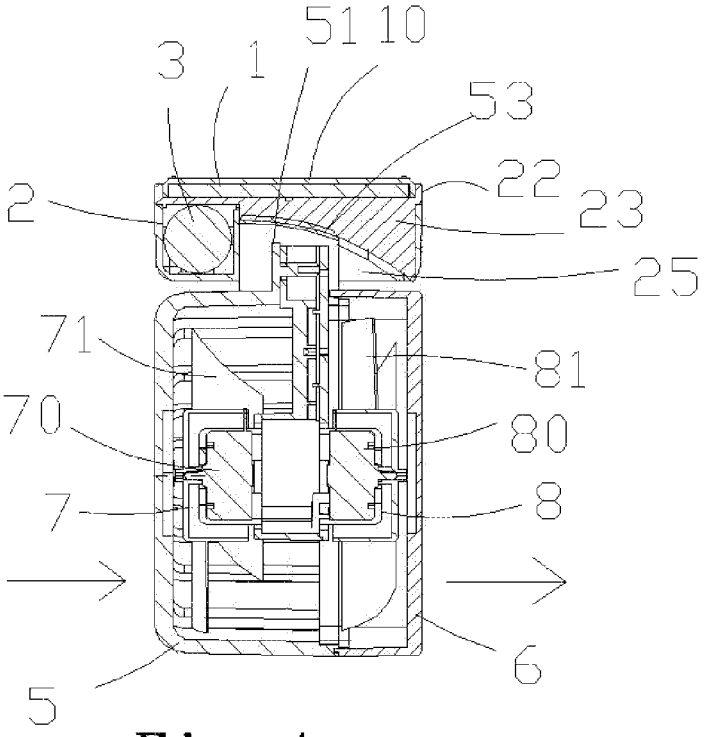
FIG. 4 is a cross-sectional view of the solar fan.
Figure 5:
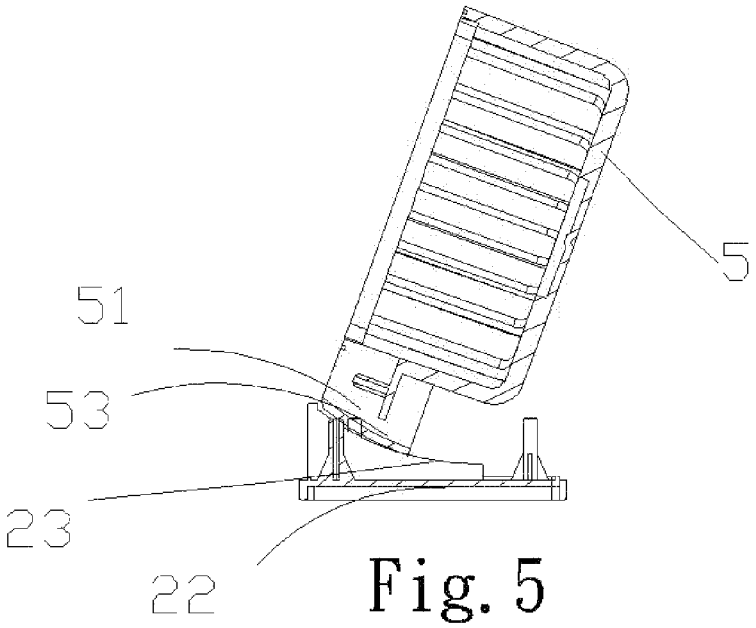
FIG. 5 is a side view of the solar fan wherein its rear grille has been angularly adjusted with respect to its casing base.
Figure 6:
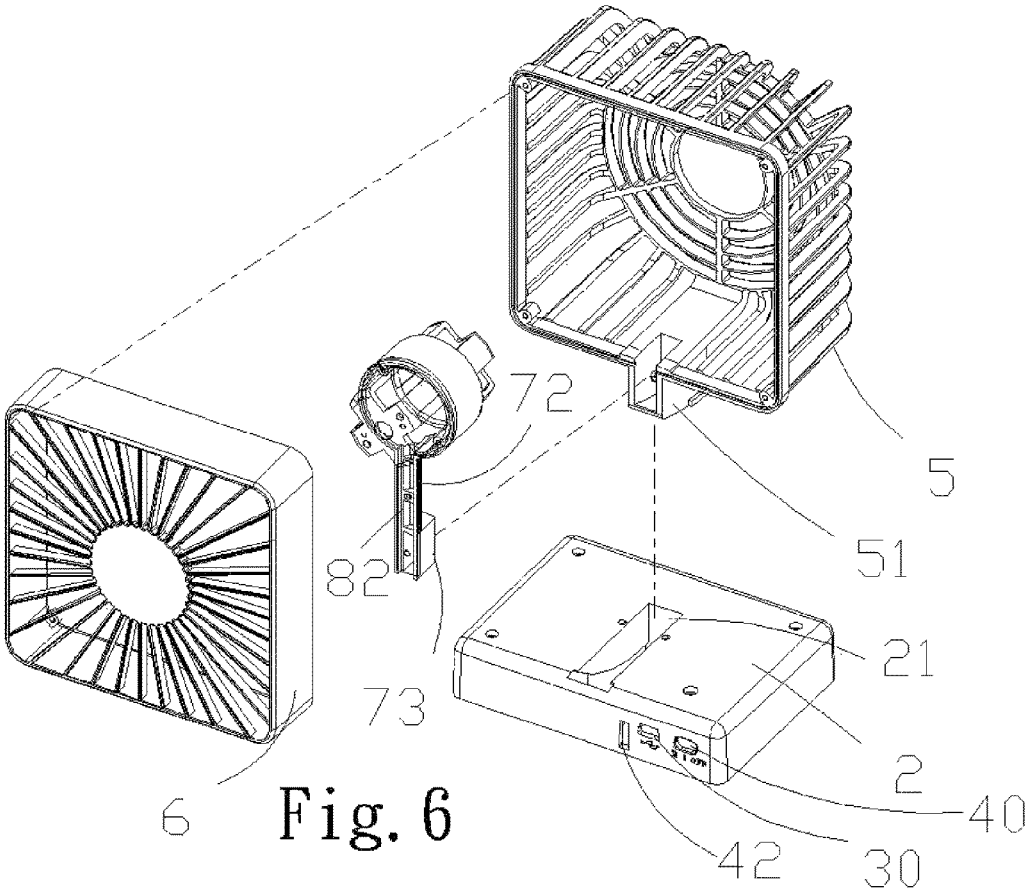
FIG. 6 is a partially exploded view of the solar fan.
Figure 7:
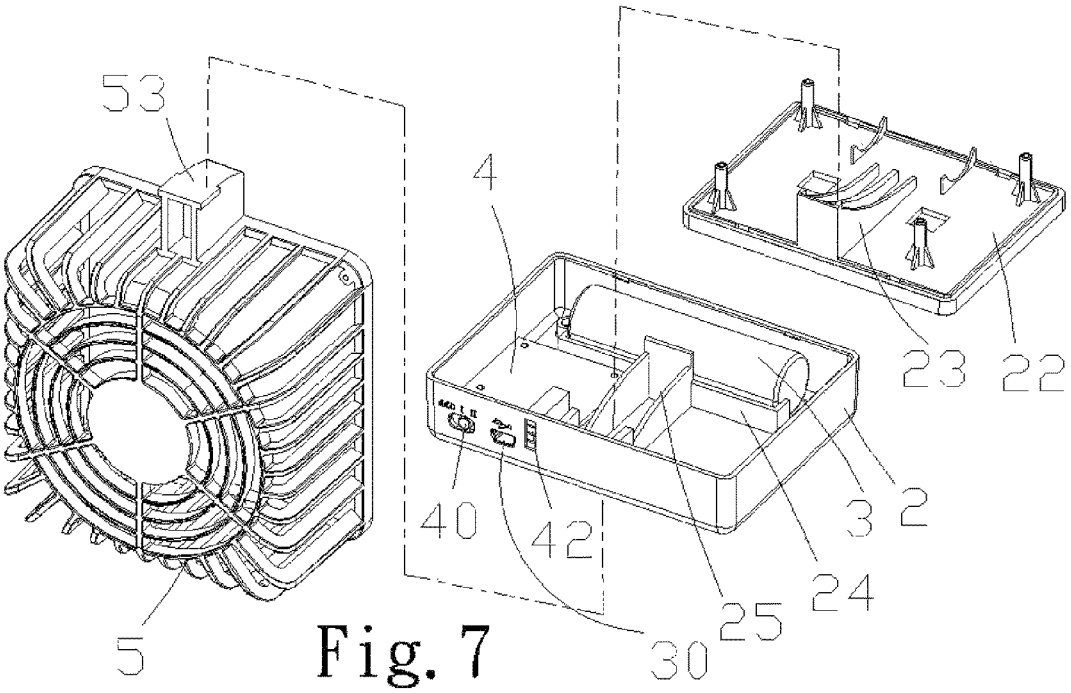
FIG. 7 is another partially exploded view of the solar fan particularly showing the rear grille, the casing and the base.

Referring to FIG. 1 through FIG. 7, according to the present invention, a solar fan comprises a solar panel 1. The solar panel 1 is deposited inside a transparent protective plate 10. The protective plate 10 is positioned on a surface of a casing 2 (by fitting hook buckles 11 at edges of the protective plate 10 into retaining recesses 26 formed on the casing 2), so that the solar energy can be converted into electricity by the solar panel 1 and transmitted to a solar cell 3 in the casing 2 for storage. The solar cell 3 is deposited in a battery seat 24 in the base 22 of the casing 2. The casing 2 is atop provided with a socket 21 for receiving and thereby positioning a projecting head 51 formed at a lower end of a rear grille 5 (shown as a square frame). The projecting head 51 has a positioning slot 52, which allows a bulge 73 at a lower end of a rear motor mount 7 to be inserted therein and fixed thereto (as shown in FIG. 7). The rear motor mount 7 has its upper end mandrel 74 combined with a rear motor 70. A front motor mount 8 is a top mounted mandrel 84 with a front motor 80. The front motor 80 and the rear motor 70 have their mandrels installed with a front blade set 81 and a rear blade set 71, respectively. The front motor mount 8 has its shaft 82 coupled with the frame 72 of the rear motor mount 7. Then a front grille 6 (shown as a square frame) is peripherally combined with the rear grille 5 (by using four screws at four corners of the square frames, as shown in FIG. 6). The casing 2 contains therein a circuit board 4. The circuit board 4 is connected to a switch for speed and power control 41 (as a three-phase switch equipped with a switch cap 40, for turning off the fan or making it operate at a first or a second wind speed) deposited at a lateral of the casing 2, an indication lamp set 42 (connected to the circuit board 4 via an electric cord and a connector), and the solar cell 3 (connected to the circuit board 4 via an electric cord and a connector). The front motor 80 and the rear motor 70 are electrically connected to the circuit board 4 (using an electric cord that extends outward from the positioning slot 52 and then gets connected to the circuit board 4 via a connector). A USB socket 30 provided at the lateral of the casing 2 is electrically connected to the circuit board 4 (via an electric cord and a connector, for allowing the fan to be charged using the grid). Therein, the front blade set (shown as having seven blades) and the rear blade set (shown as having five blades) both face ahead (as indicated by the arrow in FIG. 4, FIG. 1). The casing 2 has its inner bottom provided with an upper curved guide 25, while the base 22 of the casing 2 is provided with a lower curved guide 23. The upper and lower curved guides 25, 23 fittingly receive a curved surface 53 formed at a bottom of the projecting head 51, so that the two grilles 5, 6 can be angularly adjusted with respect to the base 22 (as shown in FIG. 5). The upper curved guide 25 is formed at two inner lateral of the socket 21, so that the projecting head 51 can easily slide in and get gripped and fixed (as shown in FIG. 4).

With the aforementioned configuration, the present invention implements a casing uniquely designed to combine and power a pair of fans, so that a circuit for solar energy can be adequately applied to an electrical fan, making the cooling green. The present is understandable and implementable, so as to have excellent usability and convenience, thus being superior to the prior art.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A solar fan, comprising a solar panel; the solar panel having a transparent protective plate; the protective plate being positioned at a first surface of a casing, so that solar energy can be converted into electricity that is then transmitted to a solar cell in the casing for storage; the casing on a second surface opposite the first surface being provided with a socket for positioning a projecting head attached to a lower end of a rear grille; the projecting head having a positioning slot; the positioning slot having a first end of a rear motor mount inserted therein and fixed thereto; the rear motor mount having a second end combined with a rear motor; a front motor mount fixed to the rear motor mount and to a front motor with a front motor; the front and rear motors having mandrels thereof installed with a front blade set and a rear blade set, respectively; the front motor mount having a shaft portion coupled to a frame of the rear motor mount between the first end and the second end of the rear motor mount; front grille attached to the rear grille; the casing containing therein a circuit board that is connected to a switch for speed and power control and an indication lamp set in an exterior wall of the casing and adjacent to the solar cell; and the front and rear motors being electrically connected to the circuit board.

2. The solar fan of claim 1, further comprising a USB socket that is in the exterior wall of the casing and electrically connected to the circuit board.

3. The solar fan of claim 1, wherein each of the front grille and the rear grille is a square frame.

4. The solar fan of claim 1, wherein both of the front blade set and the rear blade set are oriented to produce a flow in a same direction.

5. The solar fan of claim 1, wherein front blade set includes seven blades, and the rear blade set includes five blades.

6. The solar fan of claim 1, wherein the first surface of the casing has the socket thereof provided with a curved guide, and a base of the casing located on a side of the casing opposite the first surface is provided with a curved guide accessible through the socket in the first surface of the casing, so that the curved guide of the casing and base fittingly receive a curved surface formed on the projecting head.

* * * * *